United States Patent [19]

Kirchbrücher et al.

[11] 4,327,946

[45] May 4, 1982

[54] APPARATUS FOR CONTROLLING THE POSITION OF A MINERAL MINING MACHINE

[75] Inventors: Rüdiger Kirchbrücher, Dortmund-Brackel; Kunibert Becker, Werl, both of Fed. Rep. of Germany

[73] Assignee: Gewerkschaft Eisenhutte Westfalia, Fed. Rep. of Germany

[21] Appl. No.: 200,209

[22] Filed: Oct. 24, 1980

[30] Foreign Application Priority Data

Nov. 7, 1979 [DE] Fed. Rep. of Germany ..... 2944885

[51] Int. Cl.[3] ..... E21C 35/08

[52] U.S. Cl. ..... 299/33; 299/43

[58] Field of Search ..... 299/32, 33, 34, 43

[56] References Cited

U.S. PATENT DOCUMENTS

| | | | |
|---|---|---|---|
| 3,915,500 | 10/1975 | Schlusener et al. | 299/32 |
| 4,045,089 | 8/1977 | Hauschopp et al. | 299/43 |
| 4,186,969 | 2/1980 | Beckmann | 299/43 |
| 4,200,338 | 4/1980 | Beckmann | 299/34 X |

*Primary Examiner*—Ernest R. Purser

*Attorney, Agent, or Firm*—Thompson, Birch, Gauthier & Samuels

[57] ABSTRACT

Apparatus for controlling the position of a mineral winning machine, such as a plough, movable along a guide at one side of a scraper-chain conveyor employs cantilevered beams extending between the conveyor and roof supports as known per se. Brackets are provided at the goaf side of the conveyor and these brackets are pivotably coupled to the cantilever arms by way of flat pan-like components. Upstanding piston and cylinder units are positioned close to the conveyor goaf side wall preferably within protective walls of the brackets. These units are pivotably connected at their upper ends to the brackets and to extensions of the pan-like components so that the beams are effectively pivotably coupled to the units at positions offset towards the conveyor relative to the pivot connections with the brackets. The space between the conveyor and the supports is relatively unrestricted. The units are extended or retracted to tilt the conveyor and the guide whereby to control the cutting position of the machine.

17 Claims, 3 Drawing Figures

APPARATUS FOR CONTROLLING THE POSITION OF A MINERAL MINING MACHINE

BACKGROUND OF THE INVENTION

The present invention relates in general to mineral mining installations and, more particularly, to apparatus for controlling the position of a mineral mining or winning machine movable along guide means.

One form of control apparatus, described in German patent specification No. 2 319 910, uses hydraulic piston and cylinder units connected between the guide means and elongate beams pivotable in relation to the guide means and guided on roof supports. In this known construction the guide means takes the form of a scraper-chain conveyor having a machine guide on its mineral-face side and the units are coupled to brackets on the conveyor goaf side. Similar known control apparatuses are also described in U.S. Pat. Nos. 4,045,089 and 4,186,969. In these known constructions the piston and cylinder units, which are used to tilt the conveyor and its guide into various inclinations, are connected to the beams at positions spaced outwardly from the conveyor relative to the positions at which the beams connect with the brackets. The beams are usually guided at their ends remote from the conveyor for movement in the direction of advancement of the conveyor and the machine and shifting rams act on the conveyor via the beams to advance the latter to follow the winning progress. The beams are restrained from vertical movement at their rear ends although swinging or angular mobility is permitted. The beams also serve to align and guide the roof supports when these are drawn up to follow the advancement of the conveyor. There is a direct relationship between the stroke of the piston and cylinder units and the inclination of the conveyor and its guide and this is not influenced to any great extent by unevenness in the level of the floor of the mine working since the contact zones between the floor and the various parts of the mine installation are well spaced apart. The known forms of control apparatus have generally performed well but their main disadvantage is that the space between the conveyor and the roof supports tends to become restricted and access is difficult. Moreover, the known positioning of the piston and cylinder units tends to produce a fairly low torque for adjusting the guide position because there is a relatively short fulcrum lever distance and, to compensate, a large number of units may need to be provided for heavy-duty constructions.

A general object of the present invention is to provide an improved form of control apparatus.

SUMMARY OF THE INVENTION

Apparatus constructed in accordance with the invention may comprise connection means formed on guide means along which a mining machine is movable, piston and cylinder units pivotably connected to said connection means, and cantilevered beams pivotably connected to said connection means and pivotably and displaceably connected with roof supports. In contrast to known apparatus, the piston and cylinder units are pivotably connected to the beams at pivot locations closer to the guide means than the pivot locations between the connection means and the beams and below the pivot locations between the units and the connection means.

One form of apparatus constructed in accordance with the invention comprises brackets formed on the machine guide means, cantilevered beams guided remote from the guide means on roof supports, coupling means pivotably connected to the brackets for coupling the beams to the brackets, and piston and cylinder units pivotably connected at lower ends to the coupling means and at upper ends to the brackets, the pivot axes between the coupling means and the lower ends of the units being closer to the guide means than the pivot axes between the coupling means and the brackets whereby extension and retraction of the units will tilt the guide means whereby to control the position of the machine.

As is known, the guide means can take the form of a conveyor, e.g. a scraper-chain conveyor, having a guide at one side and the connection means or brackets at the opposite side. The units can locate in positions substantially upright, closely adjacent to and parallel to the goaf side of the conveyor. The coupling means, which preferably serve to connect the beams to the brackets and to the units, may take the form of individual coupling components directly pivoted to the units and to the connection means or brackets. A pair of resilient beams can be linked to each such component. The coupling components are preferably flat, shallow pan-like structures with extensions which terminate closely-adjacent the guide means. The extensions of the coupling components are pivotably connected to the units and to the connection means. The brackets themselves can extend upwardly beyond the goaf side of the conveyor and the pivot connections between the units and the brackets can be located above the goaf side of the conveyor.

The brackets may each have a pair of walls projecting outwardly from the goaf side of the conveyor and the units are each located in a protected position between the walls of an associated bracket. The overall width of the brackets along the conveyor can be quite small. Conveniently, the extensions of the coupling components can each take the form of a pair of walls parallel to the walls of an associated bracket and these extension walls can locate between the bracket walls. Pivot pins can then extend between the extension walls and the associated bracket walls and between the extension walls and the associated piston and cylinder units. It is desirable to shape the bracket walls to provide an L-shaped profile thereto. These walls can then serve to protect the units and pivot connections. Access for assembly or disassembly can be accomplished by the provision of apertures in the bracket walls.

Apparatus constructed in accordance with the foregoing does not unduly restrict the space between the conveyor and the roof supports but the positioning of the pivot joints can permit the units to exert the tilting forces with a comparatively large fulcrum lever distance.

Another form of apparatus constructed in accordance with the invention comprises at least one bracket provided on one side of a conveyor, said bracket having L-shaped parallel walls projecting outwardly from said one side and upwardly beyond said one side, a piston and cylinder units located substantially parallel to said one side of the conveyor and between the walls of said bracket, a first pivot joint formed between the upper end of the unit and the walls of the bracket, at least one cantilever beam displaceably guided on a separate support structure spaced from the one side of the conveyor, a coupling component connected with said beam and having walls projecting parallel to the walls of the bracket, a second pivot joint formed between the walls of the coupling component and the walls of the bracket and a third pivot joint formed between the walls of the coupling component and the lower end of the unit, wherein the pivot axes of said pivot joints lies substantially parallel to the conveyor and wherein the pivot axes of the second and third pivot joints are spaced apart with the axis of the third pivot joint closer to the one side of the conveyor than the axis of the second pivot joint.

The invention may understood more readily, and various other features of the invention may become apparent, from consideration of the following description.

BRIEF DESCRIPTION OF THE DRAWINGS

An embodiment of the invention will now be described, by way of example only, with reference to the accompanying drawing, wherein.

DESCRIPTION OF PREFERRED EMBODIMENT

Figure 1:
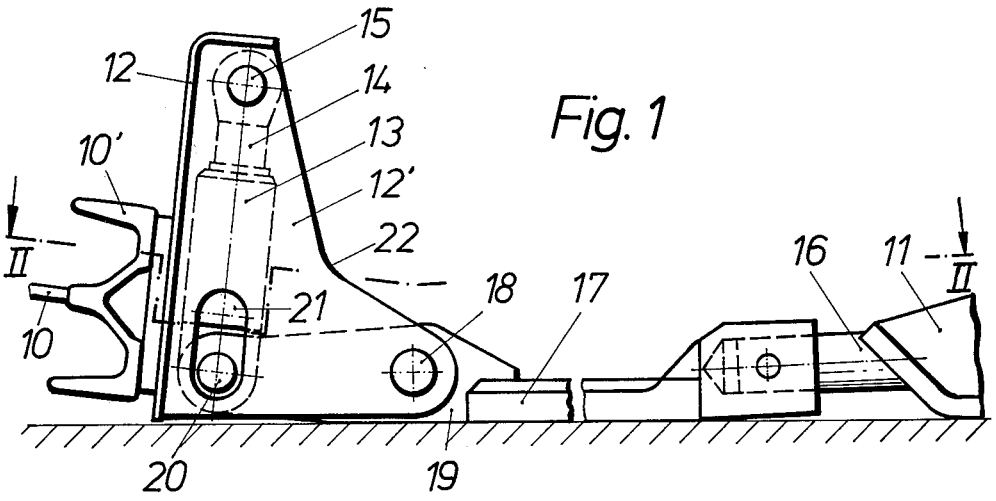
FIG. 1 is a schematic side view of part of a mineral mining installation employing apparatus constructed in accordance with the invention.

As partly represented in FIG. 1, a conveyor 10 of a mineral mining installation is in the form of a scraper-chain conveyor constructed from individual pans or channel sections interconnected at their ends for limited mutual displacement. As is known, the conveyor 10 extends alongside a mineral, e.g. coal, face, and is advanced or shifted towards the face in sections in a snaking movement to follow up the mineral winning progress. At the mineral face side, the conveyor 10 is provided with a guide (not shown) which serves to guide a winning machine, such as a plough (likewise not shown). The machine is moved back and forth along the guide means constituted by the conveyor and guide to win mineral from the face in known manner. For convenience, only the goaf side of the conveyor 10 is shown in the drawing. The machine guide itself can be formed from ramp-like plates as is known and reference is made to German patent specification No. 2 319 910 which describes a suitable guide construction.

Figure 2:
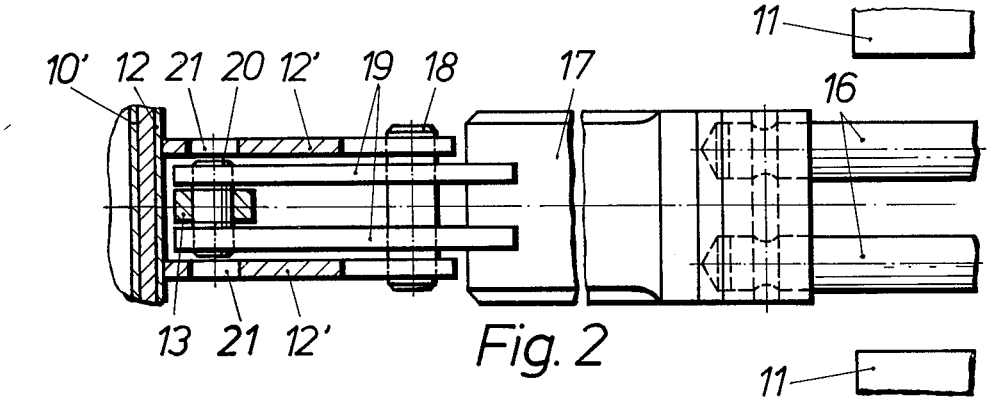
FIG. 2 is a part-sectional plan view of the apparatus depicted in FIG. 1—the view being taken along the line the line II—II of FIG. 1.

Spaced from the goaf side of the conveyor 10 there are roof supports but for convenience only part of the floor-engaging structure 11 of one of these supports is represented in FIGS. 1 and 2. Brackets 12 are attached to the goaf side wall 10' of the conveyor 10 to provide connections thereto. These brackets 12 extend upwardly beyond the upper surface of the goaf side wall 10' of the conveyor 10. The brackets 12 each have a pair of spaced-apart, parallel L-shaped walls 12' projecting outwardly from the goaf side wall 10' of the conveyor 10. Piston and cylinder units 13 are fitted to the brackets 12 each in a protected, generally upstanding position between the walls 12' of the associated bracket 12. The units 13 have piston rods 14 connected to pivot pins or joints 15 formed near the upper ends of the brackets 12 with their pivot axes extending perpendicular to the bracket walls 12'. The units 13 are located closely adjacent to the goaf side wall 10' of the conveyor 10 with their longitudinal axes substantially parallel to this side wall 10'.

Each of the roof supports is associated with a pair of parallel cantilevered resilient beams 16 generally associated with the guide and shifting system thereof. The front ends of each pair of associated beams 16 are interconnected by means of a coupling component 17. This component 17 is of substantially flat plate-like form, preferably with shallow side walls imparting a trough or channel shaped cross-section thereto. The component 17 has an extension in the form of a pair of upstanding ribs or walls 19 which project between the walls 12' of an associated bracket 12 in mutual parallelism. A pivot pin 18 extends through bores in the walls 19, 12' thereby to interconnect pivotably the component 17, and hence the beams 16, to the associated bracket 12. The extension walls 19 project well beyond the pivot pin 18 towards the conveyor 10 to terminate close to the goaf side wall 10' thereof. A further pivot pin 20 interconnects the end region of the extension walls 19 to the lower end of the cylinder of the piston and cylinder unit 13 inside the associated bracket 12. The pivot axes defined by the pivot pins or joints 15, 18, 20 are parallel to one another. The axes defined by the pins 18, 20 are spatially offset as shown to permit the unit 13 to exert an adequate torque to adjust the inclination of the conveyor and its guide about the beams 16. Access for assembly or disassembly of the arrangement is provided by apertures, here in the form of elongate slots 21, in the bracket walls 12' which expose the pivot pin 20. The pin 20 can thus be inserted or withdrawn through these slots 21. The walls 12' are recessed as at 22 to provide a characteristic somewhat L-shaped side view to protect the units 13 and the pivot joints 20, 18.

Figure 3:
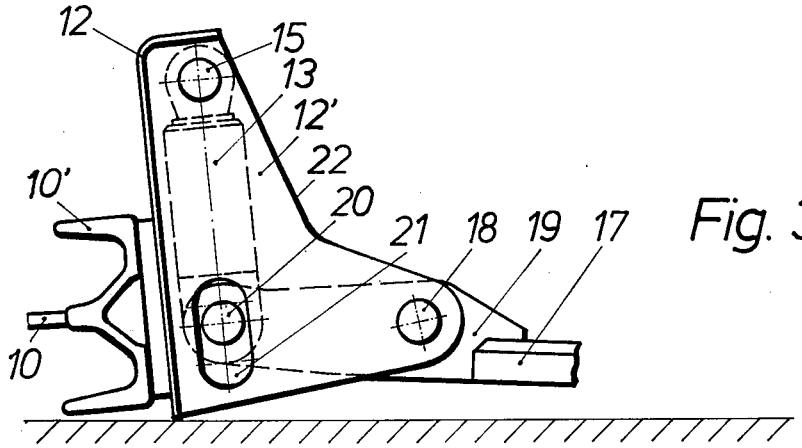
FIG. 3 is a schematic side view of the apparatus corresponding to FIG. 1 but showing the apparatus in a different operating position.

The floor structures 11 of the supports have guides which support the rear, goaf regions of the associated beams 16 for displacement in the direction of shifting or advancement. The beams 16 are restrained for vertical movement at the rear ends but angular mobility in relation to the floor structures 11 is permitted. One or more shifting rams act through the beams 16 to urge the conveyor 10 towards the mineral face or the draw up the support in known manner. By appropriate control of the units 13 the conveyor 10 and its guide can be made to tilt or swivel about the component 17 and the beams 16. With the units 13 set as represented in FIG. 1, the conveyor 10 and its guide are tilted to raise the guide whereby to make the winning machine "climb". Relative retraction of the units 13 will then bring the guide into a lowered position as shown in FIG. 3 to force the machine to act lower down whereby to "dip".

The units 13 each maintain a position parallel to the goaf side wall 10' of the conveyor 10 no matter whether the units 13 are fully extended or fully retracted or set to some intermediate position. This enables the units 13 to be positioned close to the goaf side wall 10' as shown and the space or zone between the conveyor 10 and the roof supports, in which the shallow components 17 are located, is left relatively unrestricted. Despite the position of the units 13 close to the wall 10' of the conveyor 10, the units 13 can still provide adequate tilting forces to the conveyor 10 and the machine guide.

It is possible to modify the apparatus as described and illustrated by reversing the units 13 so that the piston rods 14 are coupled to the extension walls 19 of the components 17 by way of the pivot pins 20 while the cylinders are coupled to the brackets 12 with the pivot pins 15. It is also possible to intersperse additional parts, such as spring means, between the units 13 and the brackets 12 or elsewhere.

We claim:

1. In an apparatus for controlling the position of a mineral mining machine movable along guide means; said apparatus comprising connection means formed on the guide means, piston and cylinder units pivotably connected to said connection means, and cantilevered beams pivotably connected to said connection means and pivotably and displaceably connected with roof supports, the improvement comprising the piston and cylinder units are pivotably connected to the beams at pivot locations closer to the guide means than the pivot locations between the connection means and the beams and below the pivot locations between the units and the connection means.

2. Apparatus according to claim 1, wherein the connection means comprise brackets.

3. Apparatus according to claim 1, wherein the guide means is a scraper-chain conveyor with a machine guide at one side and the connection means at the opposite side.

4. Apparatus according to claim 1, wherein the beams are connected to coupling components and said components are directly pivotably connected to the units and to the connection means.

5. Apparatus according to claim 4, wherein the coupling components are of flat pan-like form and have extensions which terminate closely adjacent the guide means and wherein the extensions of the coupling components are pivotably connected to the units and to the connection means.

6. Apparatus for controlling the position of a mineral mining machine movable along guide means; said apparatus comprising brackets formed on the guide means, cantilevered beams guided remote from the guide means on roof supports, coupling means pivotably connected to the brackets for coupling the beams to the brackets and piston and cylinder units pivotably connected at lower ends to the coupling means and at upper ends to the brackets, the pivot axes between the coupling means and the lower ends of the units being closer to the guide means than the pivot axes between the coupling means and the brackets whereby extension and retraction of the units will tilt the guide means whereby to control the position of the machine.

7. Apparatus according to claim 2, wherein the guide means is a scraper-chain conveyor with a machine guide on one mineral-face side and the brackets on the opposite goaf side.

8. Apparatus according to claim 7, wherein the units are located substantially parallel to said conveyor goaf side.

9. Apparatus according to claim 7, wherein the beams are displaceably and pivotably guided on said supports and serve to impart shifting forces to the conveyor.

10. Apparatus according to claim 7, wherein the brackets extend upwardly beyond the goaf side of the conveyor and the pivot connections between the units and the brackets are located above the goaf side of the conveyor.

11. Apparatus according to claim 10, wherein the brackets each have a pair of parallel walls projecting outwardly from the goaf side of the conveyor and the units are each located in a protected position between the walls of an associated bracket.

12. Apparatus according to claim 11, wherein the coupling means comprises flat pan-like components each provided with an extension in the form of a pair of parallel walls which locate alongside the walls of an associated bracket and wherein pivot pins extend between the extension walls and the associated bracket walls and between the extension walls and the associated unit.

13. Apparatus according to claim 11, wherein the walls of the brackets have a substantially L-shaped profile to protect both the units and the pivot connections.

14. Apparatus according to claim 11, wherein the walls of each the brackets have apertures therein permitting access for assembly and disassembly of at least the pivot connection between the associated unit and coupling means.

15. Apparatus according to claim 6, wherein the coupling means comprises flat pan-like components each provided with an extension pivotably connected to an associated bracket and to an associated unit.

16. Apparatus according to claim 6, wherein the beams are resilient and are arranged in pairs each pair of beams being connected through a coupling component, constituting part of the coupling means, to one of the brackets and to an associated one of the units.

17. Apparatus for controlling the position of a mineral winning machine guided for movement along a guide formed on a scraper-chain conveyor, said apparatus comprising at least one bracket provided on one side of the conveyor, said bracket having L-shaped parallel walls projecting outwardly from said one side and upwardly beyond said one side, a piston and cylinder unit located substantially parallel to said one side of the conveyor and between the walls of said bracket, a first pivot joint formed between the upper end of the unit and the walls of the bracket, at least one cantilever beam displaceably guided on a separate support structure spaced from the one side of the conveyor, a coupling component connected with said beam and having walls projecting parallel to the walls of the bracket, a second pivot joint formed between the walls of the coupling component and the walls of the bracket and a third pivot joint formed between the walls of the coupling component and the lower end of the unit, wherein the pivot axes of said pivot joints extend parallel to one another and substantially parallel to the conveyor and wherein the pivot axes of the second and third pivot joints are spaced apart with the axis of the third pivot joint closer to the one side of the conveyor than the axis of the second pivot joint.

* * * * *